United States Patent [19]

Haka

[11] 4,342,299

[45] Aug. 3, 1982

[54] THROTTLE POSITIONING SYSTEM

[75] Inventor: Raymond J. Haka, Rochester, Mich.

[73] Assignee: General Motors Corporation, Detroit, Mich.

[21] Appl. No.: 187,353

[22] Filed: Sep. 15, 1980

[51] Int. Cl.[3] ..... F02D 11/02

[52] U.S. Cl. ..... 123/396; 123/401

[58] Field of Search ..... 123/395, 396, 401; 261/50 A

[56] References Cited

U.S. PATENT DOCUMENTS

| | | | |
|---|---|---|---|
| 3,104,590 | 9/1963 | Kellogg et al. | 91/376 R |
| 3,215,222 | 11/1965 | Parker | 123/396 X |
| 3,352,315 | 11/1967 | Kellogg | 137/1 |
| 3,354,873 | 11/1967 | Burnell | 123/389 |
| 3,774,583 | 11/1973 | King | 123/568 |
| 3,794,004 | 2/1974 | Stoltman | 264/50 A |
| 4,077,370 | 3/1978 | Spangenberg | 308/36.1 |
| 4,210,110 | 7/1980 | Krebaum et al. | 123/396 |
| 4,220,218 | 9/1980 | Riddel | 123/401 X |

*Primary Examiner*—William A. Cuchlinski, Jr.
*Attorney, Agent, or Firm*—C. K. Veenstra

[57] ABSTRACT

A valve is positioned by a control diaphragm which senses manifold pressure in an automotive engine and by an opposing biasing spring to create a control pressure, and a servo diaphragm positions the throttle in response to variations in the control pressure to thereby maintain the manifold pressure at a value determined by the spring bias. The vehicle operator positions the accelerator pedal to vary the spring bias and thus determine the value at which the manifold pressure is maintained.

2 Claims, 1 Drawing Figure

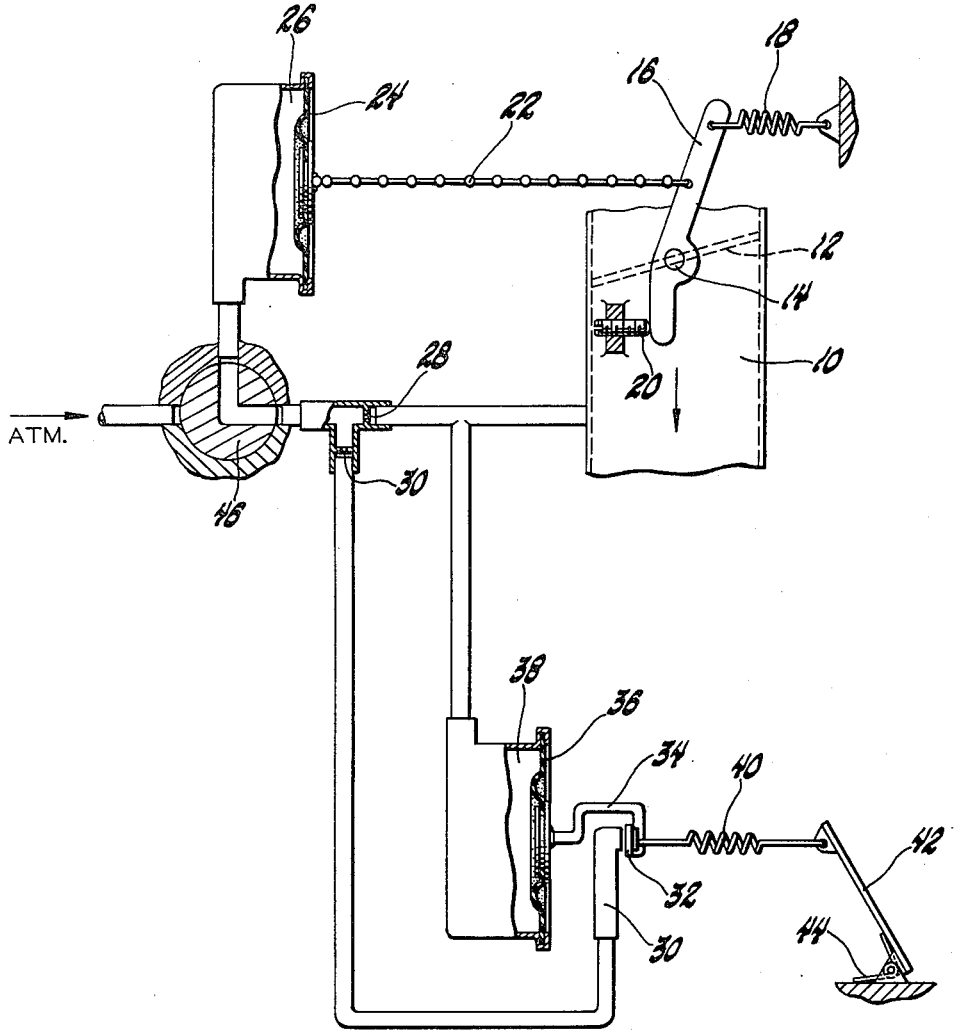
26
24
22
16
18
12
14
10
20
28
ATM.
30
46
38
36
34
40
42
32
30
44

THROTTLE POSITIONING SYSTEM

TECHNICAL FIELD

This invention relates to a throttle positioning system particularly suitable for use on an automotive engine.

BACKGROUND

The conventional throttle positioning system on an automotive engine is a mechanical linkage between the throttle and an operator control such as an accelerator pedal. In the conventional system, an input from the engine operator is directly converted to a particular throttle position, and abrupt movements of the accelerator pedal cause abrupt changes in throttle position and in the pressure in the engine induction manifold downstream of the throttle. In addition, changes in engine load cause the operator to move the accelerator pedal and throttle in search of a new throttle position which will provide the desired engine operation.

It is well known that abrupt and unnecessary changes in throttle position and manifold pressure inhibit operation with minimum emissions and fuel consumptions and, in addition, lead to annoying shift patterns with some automatic transmissions. The operator of the conventional throttle positioning system therefore has the burden of avoiding abrupt and unnecessary changes in throttle position to enjoy minimum emissions and fuel consumption and smooth vehicle operation.

SUMMARY OF THE INVENTION

In the throttle positioning system provided by this invention, on the other hand, an input from the engine operator is interpreted as a command for a particular pressure in the engine induction manifold downstream of the throttle, and the throttle is positioned automatically to maintain that manifold pressure.

The throttle positioning system provided by this invention is thus effective to maintain a substantially constant manifold pressure during nontransient engine operating conditions and to smoothly increase or decrease the manifold pressure during transient engine operating conditions. As a result, the engine is better able to operate with minimum emissions and fuel consumption and to provide smooth vehicle operation.

In the preferred embodiment of this invention, a valve is positioned by a control diaphragm which senses the manifold pressure and by an opposing biasing spring to create a control pressure, and a servo diaphragm positions the throttle in response to variations in the control pressure to thereby maintain the manifold pressure at a value determined by the spring bias. The operator control—the accelerator pedal, for example—varies the spring bias and thus determines the value at which the manifold pressure is maintained.

The details as well as other features and advantages of this invention are set forth in the remainder of the specification and are shown in the accompanying drawing.

SUMMARY OF THE DRAWING

The sole FIGURE of a drawing is a schematic view of the preferred embodiment of the throttle positioning system provided by this invention.

BEST MODE FOR CARRYING OUT THE INVENTION

Referring to the drawing, an automotive engine induction passage 10 has a throttle 12 secured to a throttle shaft 14. A throttle lever 16 is operatively connected to throttle shaft 14, and a return spring 18 biases lever 16 against an adjustable stop 20 to move throttle 12 to the closed position shown.

Throttle lever 16 is connected by a link 22 to a servo diaphragm 24 which forms a portion of a control pressure chamber 26. Control pressure chamber 26 has a restricted connection 28 for sensing the subatmospheric manifold pressure in induction passage 10 downstream of throttle 12 and a restricted air bleed 30 sensing atmospheric pressure.

Flow through air bleed 30 is controlled by a valve 32 mounted on a bracket 34 which is secured to a control diaphragm 36. Control diaphgram 36 forms a portion of a chamber 38 which senses the manifold pressure in induction passage 10 downstream of throttle 12. Control diaphragm 36 exerts a force porportional to (and varying inversely with) manifold pressure in a direction tending to position valve 32 to reduce air flow through air bleed 30. The force exerted by control diaphragm 36 is opposed by the bias exerted by a spring 40 connected between bracket 34 and a vehicle accelerator pedal 42. Accelerator pedal 42 is biased to the position shown by a torsion spring 44.

In operation, when the vehicle operator depresses accelerator pedal 42, moving it slightly counterclockwise to reduce the tension of spring 40, valve 32 moves leftwardly and reduces air flow through air bleed 30 which thereby reduces the subatmospheric control pressure in control pressure chamber 26. Servo diaphragm 24 then pulls throttle 12 counterclockwise against the return force of spring 18 to permit additional air flow through induction passage 10. The additional air flow increases the manifold pressure sensed by control diaphragm 36, and the force exerted by control diaphragm 36 is thus reduced to balance the force exerted by spring 40.

Should the manifold pressure increase due to an increase in load, the force exerted by control diaphragm 36 will be reduced and valve 32 will be pulled rightwardly by spring 40 to increase air flow through air bleed 30. The increased control pressure sensed by servo diaphragm 24 will then allow return spring 18 to move throttle 12 in a closing direction to reduce the manifold pressure to the value determined by spring 40.

Similarly, should the manifold pressure reduce due to a decrease in load, the force exerted by control diaphragm 36 will be increased to move valve 32 leftwardly against the force exerted by spring 40 and reduce air flow through air bleed 30. The reduced control pressure sensed by servo diaphragm 24 will then open throttle 12 to increase the manifold pressure to the value determined by spring 40.

When the operator releases accelerator pedal 42 and it is rotated clockwise by spring 44, the tension of spring 40 is increased to move valve 32 rightwardly. The resulting increase in air flow through air bleed 30 increases the control pressure sensed by servo diaphragm 24, and spring 18 closes throttle 12 to reduce the induction passage pressure to the new value determined by spring 40.

A valve 46 is provided to disconnect control pressure chamber 26 from the subatmospheric pressure sensed through connection 28 and to apply atmospheric pressure to control pressure chamber 26. At such times, servo diaphragm 24 exerts no opening force on throttle 12, and spring 18 returns throttle 12 to the closed position shown. Valve 46 is so operated whenever the vehicle brakes are applied. It will be appreciated that valve 46 need not necessarily disconnect control pressure chamber 26 from the subatmospheric pressure sensed through connection 28 by instead may simply open a large air bleed into control pressure chamber 26.

It will be noted that in the preferred embodiment of this invention, the left side of servo diaphragm 24 forms a control pressure chamber 26 which senses subatmospheric pressure through connection 28 and atmospheric pressure through air bleed 30. It will be appreciated that, as an alternative, the right side of servo diaphragm 24 could form a control pressure chamber sensing superatmospheric pressure (from an air pump not shown) and atmospheric pressure through air bleed 30. The important characteristics of a throttle positioning system provided according to this invention are that the servo diaphragm exert a force which varies in inverse relation to the biasing force of a spring such as 40 and in direct relation to the force exerted by control diaphragm 36 and that the servo diaphragm move throttle 12 to vary the manifold pressure in direct relation to the force exerted by the servo diaphragm. In this manner, the system is effective to position the throttle to maintain the manifold pressure at the value determined by the force of spring 40.

Thus it will be appreciated that this invention may be employed in a variety of other embodiments within the scope of the following claims.

The embodiments of the invention in which an exclusive property or privilege is claimed are defined as follows:

1. A system for positioning a throttle within an engine induction passage to control the manifold pressure in said induction passage downstream of said throttle, said system comprising:

a control diaphragm forming a portion of a chamber adapted to sense said manifold pressure and exerting a force proportional to said manifold pressure, a spring exerting a biasing force which opposes the force exerted by said control diaphragm, a servo diaphragm forming a portion of a control pressure chamber, a valve positioned by said control diaphragm and said spring to create a control pressure in said control pressure chamber, said servo diaphragm exerting a force proportional to said control pressure which varies in inverse relation to said biasing force and in direct relation to the force exerted by said control diaphragm, said servo diaphragm being adapted to move said throttle to vary said manifold pressure in direct relation to the force exerted by said servo diaphragm, whereby said system is effective to position said throttle to maintain said manifold pressure at a value determined by said biasing force, and means for varying said biasing force to determine the value at which said manifold pressure is maintained.

2. A system for positioning a throttle within an engine induction passage to control the subatmospheric manifold pressure in said induction passage downstream of said throttle, said system comprising:

a control diaphragm forming a portion of a chamber adapted to sense said manifold pressure and exerting a force proportional to said manifold pressure, a spring exerting a biasing force which opposes the force exerted by said control diaphragm, a servo diaphragm forming a portion of a control pressure chamber having a connection for sensing said manifold pressure and an air bleed for sensing atmospheric pressure, a valve positioned by said control diaphragm and said spring to control flow through said air bleed and thereby create a subatmospheric control pressure in said control pressure chamber which varies in direct relation to said biasing force and in inverse relation to the force exerted by said control diaphragm, said servo diaphragm being responsive to said control pressure and adapted to move said throttle to vary said manifold pressure in inverse relation to said control pressure, whereby said system is effective to position said throttle to maintain said manifold pressure at a value determined by said biasing force, and means for varying said biasing force to determine the value at which said manifold pressure is maintained.

* * * * *